US006827671B1

(12) United States Patent
Lu et al.

(10) Patent No.: US 6,827,671 B1
(45) Date of Patent: Dec. 7, 2004

(54) BODY SHAPING MACHINE

(76) Inventors: Yu-Hui Lu, No. 209, Chengdu Rd., Situn District, Taichung City (TW); Ching-Lin Hung, 3F., No. 176, Yongsing St., North District, Taichung City (TW)

( * ) Notice: Subject to any disclaimer, the term of this patent is extended or adjusted under 35 U.S.C. 154(b) by 0 days.

(21) Appl. No.: 10/727,874

(22) Filed: Dec. 5, 2003

(51) Int. Cl.[7] ..... A63B 22/00

(52) U.S. Cl. ..... 482/51; 601/132; 601/143; 601/144; 601/145

(58) Field of Search ..... 482/51, 54, 43, 482/148; 601/101, 127–132, 143–145

(56) References Cited

U.S. PATENT DOCUMENTS 2,980,109 A * 4/1961 Schein ..... 601/145
3,344,782 A * 10/1967 Gottlieb ..... 601/145
3,344,783 A * 10/1967 Gottlieb ..... 601/145
3,921,625 A * 11/1975 Feather ..... 601/144
6,443,876 B1 * 9/2002 Huang ..... 482/54

* cited by examiner

*Primary Examiner*—Nicholas D. Lucchesi
*Assistant Examiner*—Tam Nguyen
(74) *Attorney, Agent, or Firm*—Harrison & Egbert

(57) ABSTRACT

A body shaping machine has an action mechanism and a massaging belt which is fastened at two ends to two action members of the action mechanism. The action mechanism includes two deceleration devices and two displacement devices. The deceleration devices each have an output shaft, and a crank mounted on the output shaft. The two cranks of the two deceleration devices are mounted in reverse. The rotary motions of the two cranks are changed into the reciprocating linear motions by the two displacement devices, thereby enabling the two action members to bring about linear displacement motions opposite in direction.

5 Claims, 8 Drawing Sheets

BODY SHAPING MACHINE

RELATED U.S. APPLICATIONS

Not applicable.

STATEMENT REGARDING FEDERALLY SPONSORED RESEARCH OR DEVELOPMENT

Not applicable.

FIELD OF THE INVENTION

The present invention relates to a machine which is used to attain a physical fitness.

BACKGROUND OF THE INVENTION

The conventional body shaping machine comprises a pliable belt which is, driven by two eccentric rotors mounted at two ends of a motor for bringing about a massaging effect on a bulging belly. The massaging effect is generally too harsh on the bulging belly. In another words, the conventional body shaping machine is in fact an exercise machine incapable of bringing about a mild massaging effect.

The conventional body massaging machine is capable of bringing about a massaging effect which is gentle and pleasant on a bulging abdomen; nevertheless it can not be used effectively to shape the body of a person.

BRIEF SUMMARY OF THE INVENTION

The primary objective of the present invention is to provide a body shaping machine which is capable of bringing about an exercising effect, a massaging effect, and a body fitting effect. In another words, the body shaping machine of the present invention is a three-in-one structure for use in attaining longevity.

The body shaping machine of the present invention comprises two deceleration devices, two displacement devices, and a massaging belt. The two deceleration devices comprise an output shaft on which a crank is mounted. These two cranks are mounted in reverse. The rotary motions of the cranks are changed into reciprocating linear motions of the cranks are changed into reciprocating linear motions by the displacement devices. The massaging belt is driven to engage in a back-and-forth rhythmic motion to bring about a massaging effect.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
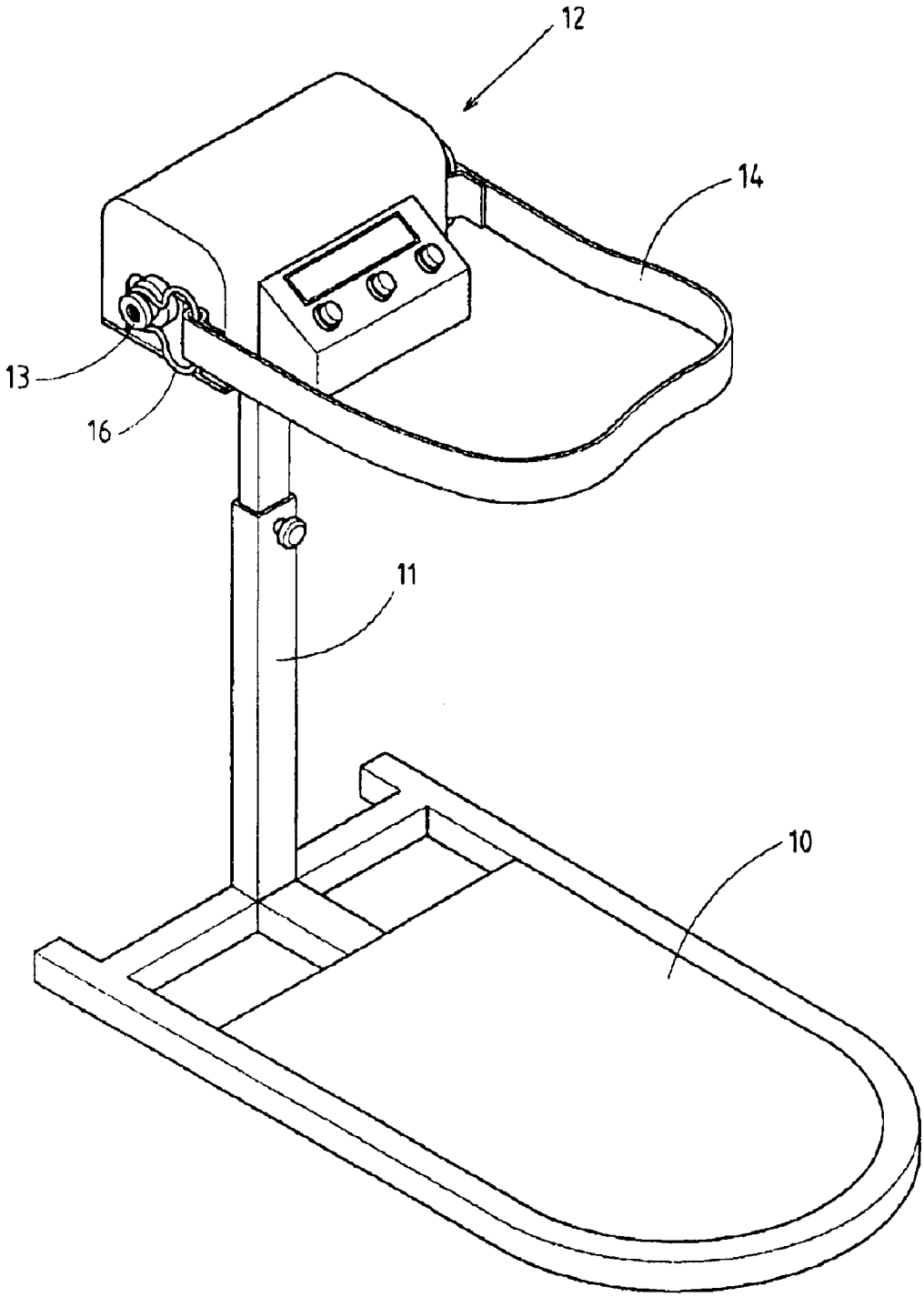
FIG. 1 shows a perspective view of a first preferred embodiment of the present invention.
Figure 2:
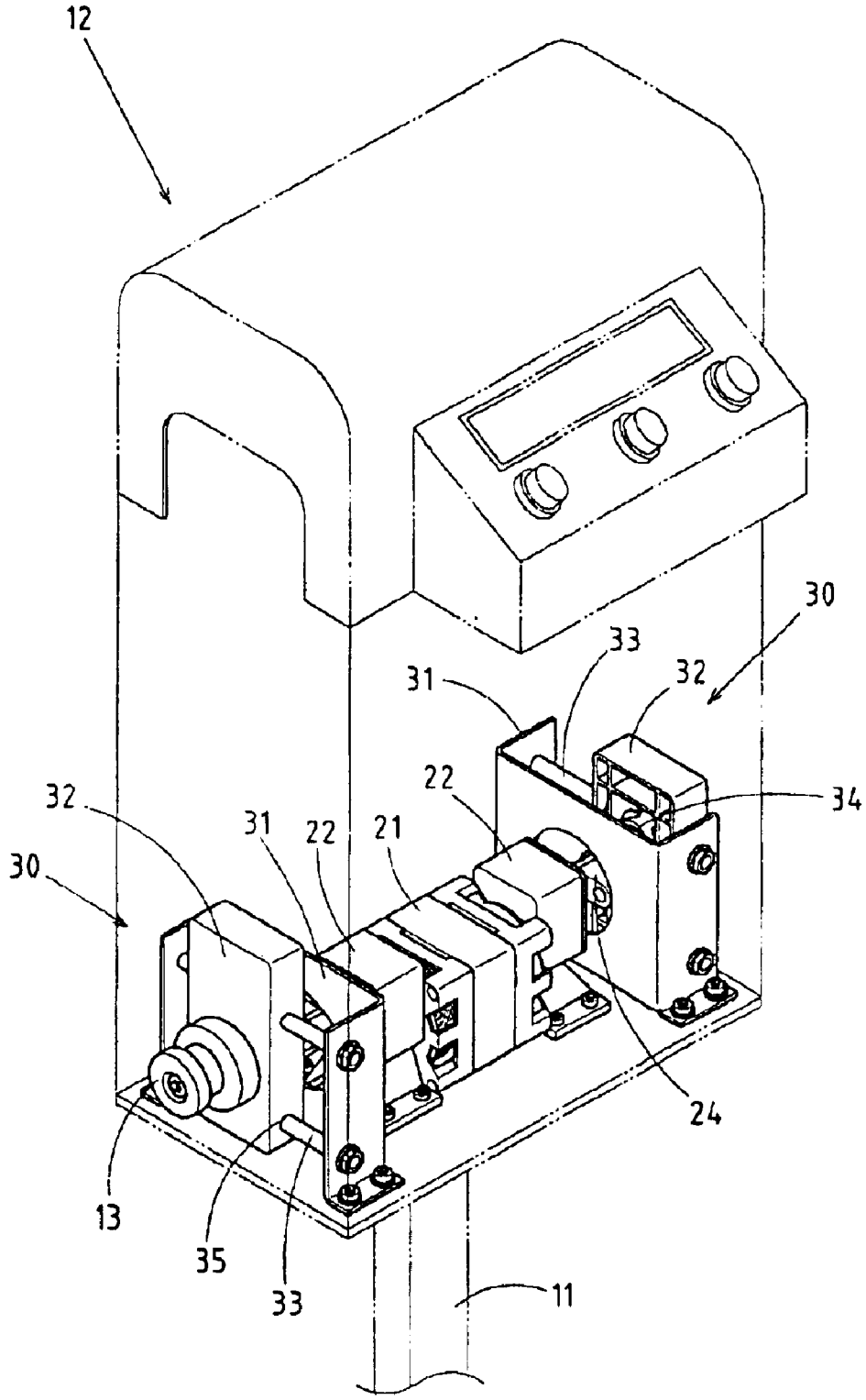
FIG. 2 shows a perspective view of an action mechanism of the present invention.
Figure 3:
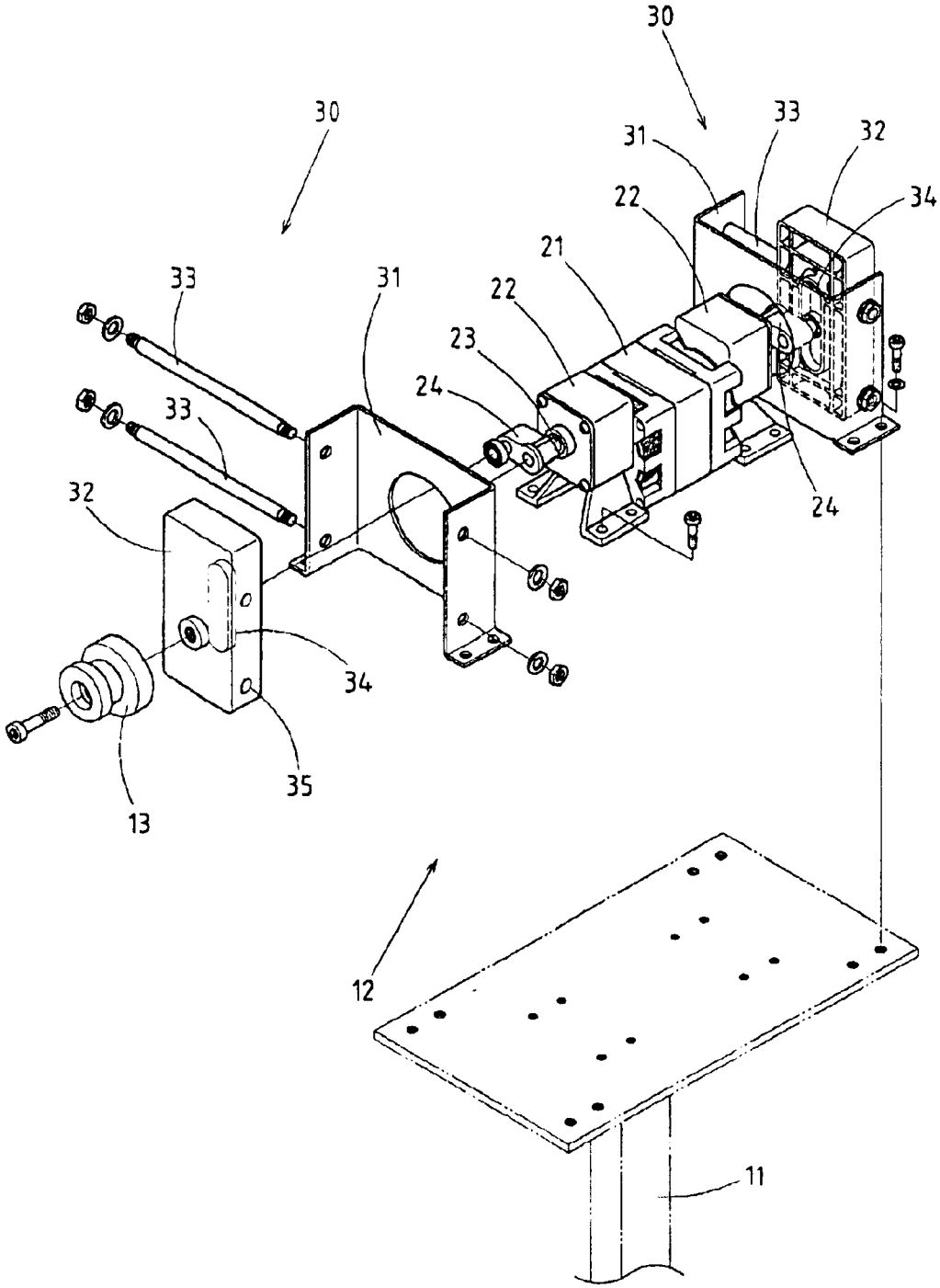
FIG. 3 shows an exploded perspective view of the action mechanism of the present invention.
Figure 4:
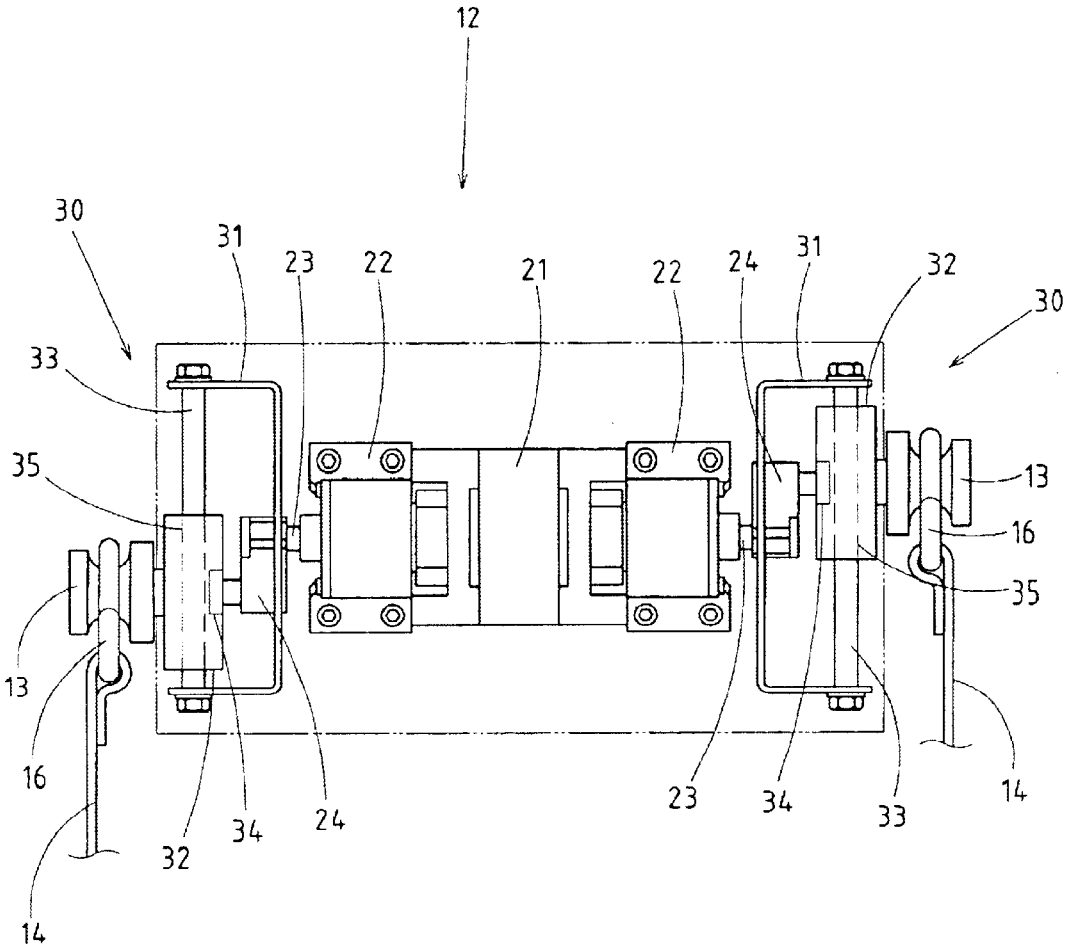
FIG. 4 shows a top view of the action mechanism of the present invention.
Figure 5:
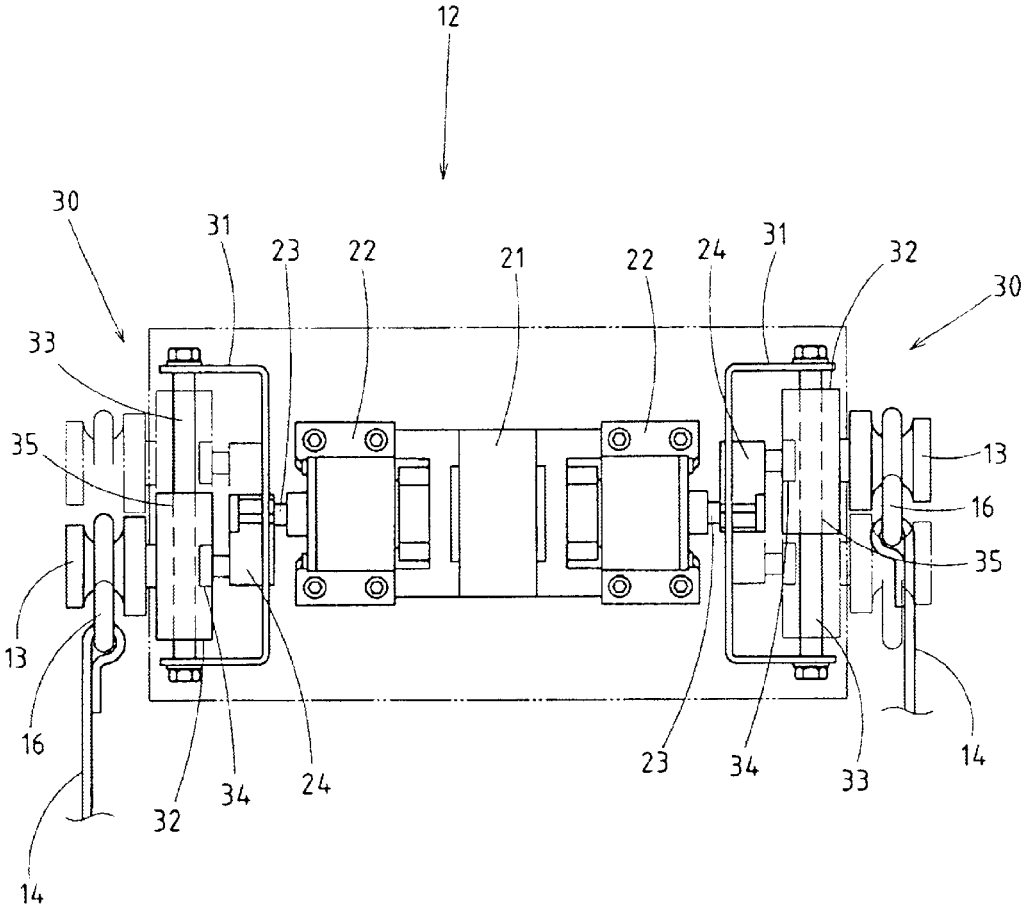
FIG. 5 shows a top view of the action mechanism of the present invention in action.
Figure 6:
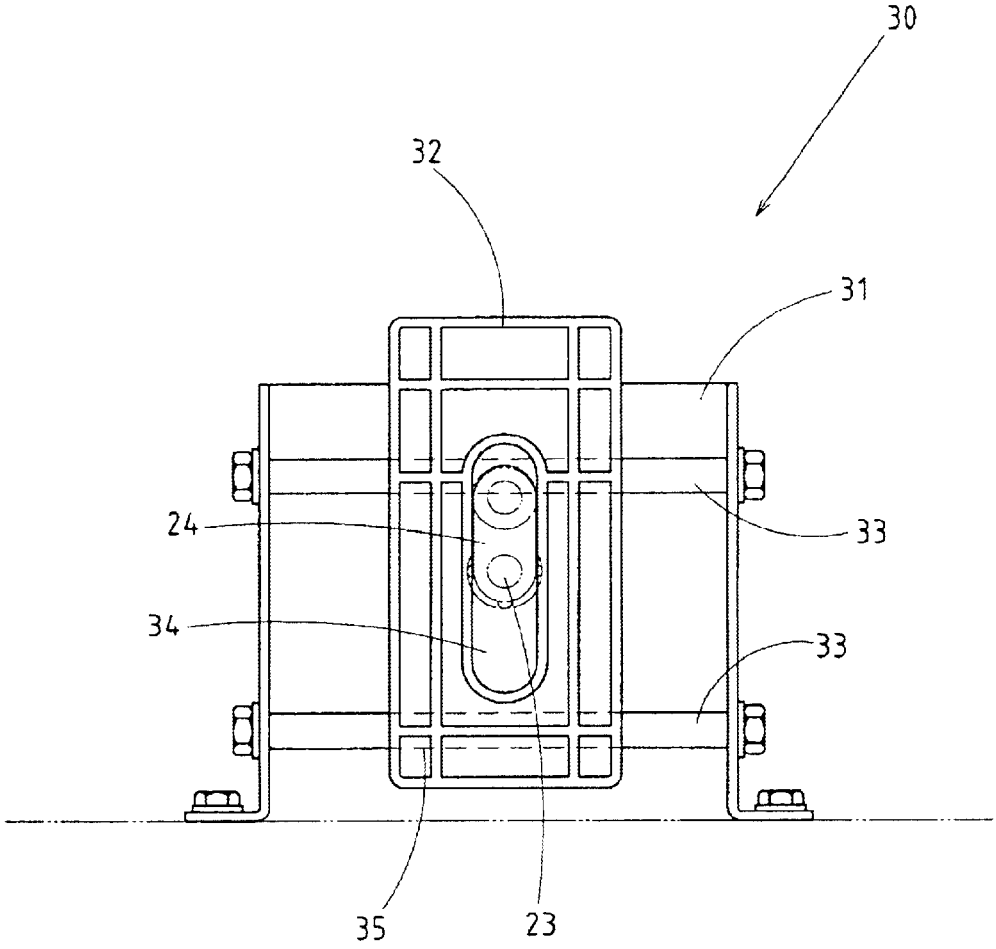
FIG. 6 shows a side schematic view of a displacement device of the present invention.
Figure 7:
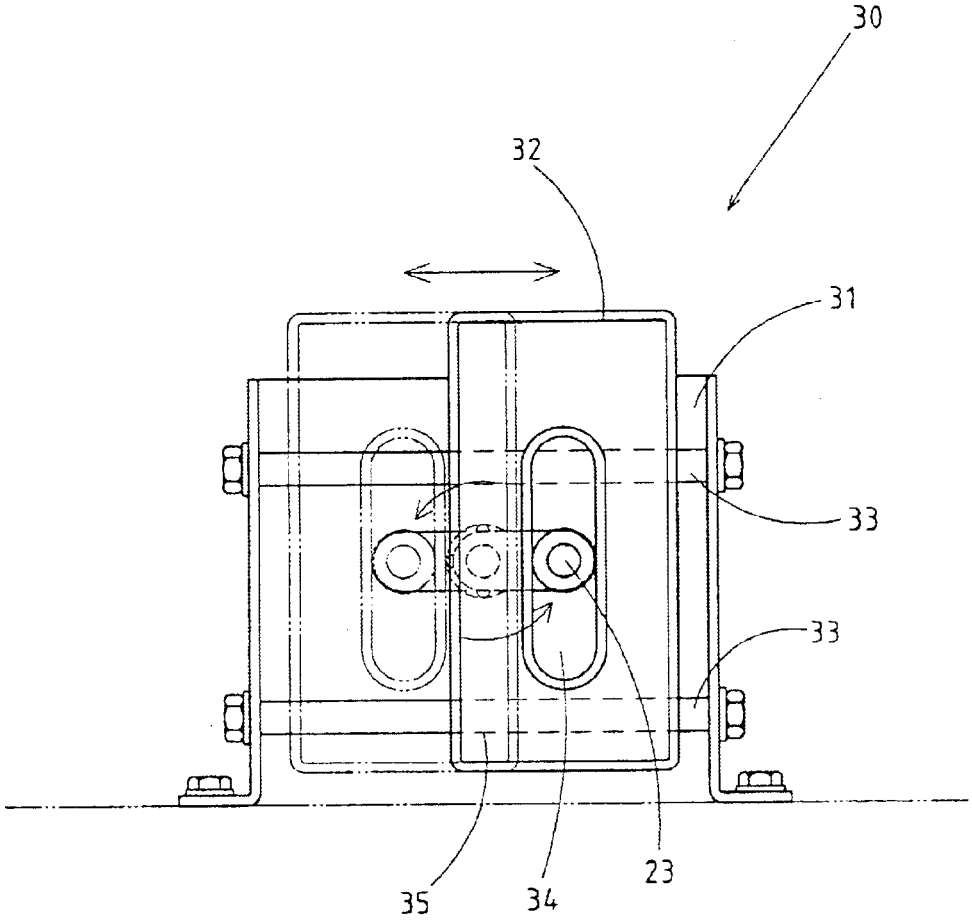
FIG. 7 shows a side schematic view of the displacement device of the present invention in action.

As shown in FIGS. 1–7, a body shaping machine of the present invention comprises a base 10, a support frame 11, an action mechanism 12, and a massaging belt 14 which is driven by two action members 13 of the action mechanism 12. The massaging belt 14 is used to rub the body of a user of the machine with pressure and friction in a back-and-forth motion.

The action mechanism 12 comprises two deceleration device 22, a drive source 21 mounted between the two deceleration devices 22, and two displacement devices 30.

The two deceleration devices 22 comprise an output shaft 23 and a crank 24 mounted on the output shaft 23. The two cranks 24 are mounted in reverse. The rotary motion of the cranks 24 is changed into a reciprocating linear motion by the displacement device 30. As a result, the two action members 13 engage in two linear displacement motions opposite in direction. The massaging belt 14 is fastened at both ends with the two action members 13 and is therefore capable of rubbing the body of the user of the machine with pressure and friction in a reciprocating motion.

The displacement devices 30 comprise a support frame 31, a slidable block 32, and a guide rod 33. The slidable block 32 is provided with a drive slot 34 for mounting the crank 24 of the deceleration devices 22. The slidable block 32 is further provided with a locating hole 35 for locating the guide rod 33 which is fastened with the support frame 31. The rotary motion of the crank 24 is changed into a back-and-forth linear motion by the slidable block 32. The slidable block 32 is fastened via the action member 13 with one end of the massaging belt 14.

Figure 8:
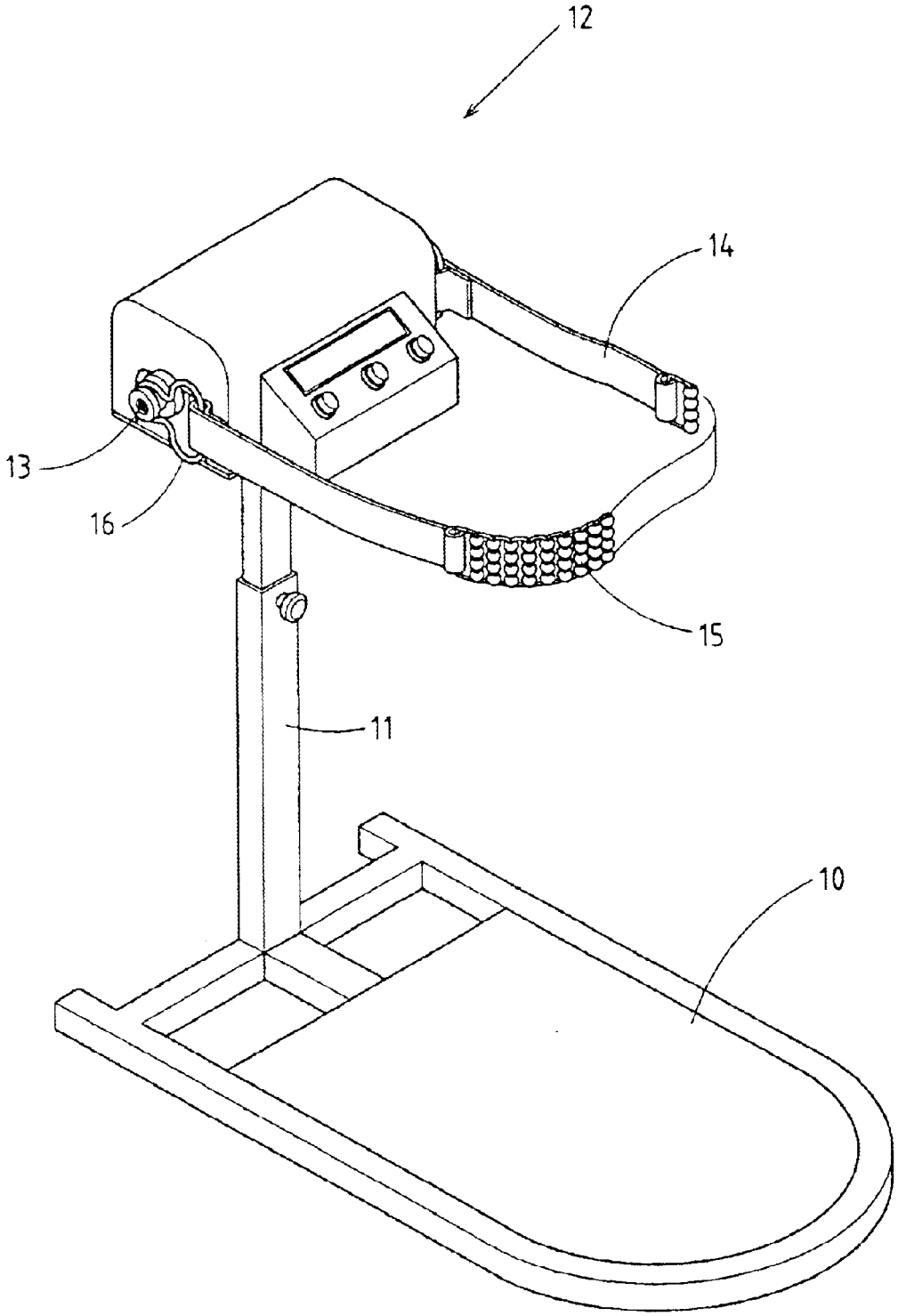
FIG. 8 shows a perspective view of a second preferred embodiment of the present invention.

As shown in FIG. 8, the massaging belt 14 of the present invention is provided with a plurality of rollers 15, which are intended to enhance the rubbing effect of the massaging belt 14.

The massaging belt 14 is provided at two ends with a retaining piece 16 by which the massaging belt 14 is detachably engaged with the action member 13.

The massaging belt 14 of the present invention is capable of applying pressure and friction to the body of a user of the machine, thereby resulting in an exercising effect and a massaging effect. However, the massaging effect of the machine of the present invention is relatively gentle by virtue of the cooperative efforts of the deceleration devices 22 and the displacement devices 30. The enhancement of the messaging effect of the massaging belt 14 of the present invention is attained by the rollers 15. The machine of the present invention is effective in attainment of a physical fitness.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

We claim:

1. A body shaping machine comprising:

a base;

a support frame mounted on said base;

an action mechanism mounted on said support frame and comprising two action members; and a massaging belt fastened at two ends thereof to said two action members of said action mechanism;

wherein said action mechanism comprises:

two deceleration devices, each device comprising an output shaft and a crank mounted on said output shaft such that the two cranks of said two deceleration devices are mounted in reverse;

a driving source mounted between said two deceleration devices; and two displacement devices for changing rotary motions of said two cranks into reciprocating linear motions opposite in direction, thereby enabling said two action members to bring about linear displacement motions opposite in direction.

2. The body shaping machine as defined in claim 1, wherein each of said two displacement devices comprises:

a support frame;

a slidable block comprised of a drive slot for engaging with said crank such that the rotary motion of said crank is changed by said slidable block into the reciprocating linear motion, said slidable block further comprised of a locating hole whereby said slidable block is fastened to one end of said massaging belt by one of said two action members; and a guide rod fastened with to said support frame is such a way that said guide rod is confined in said locating hole of said slidable block.

3. The body shaping machine as defined in claim 1, wherein said massaging belt is comprised of a plurality of massaging rollers fastened thereto.

4. The body shaping machine as defined in claim 1, wherein the two ends of said massaging belt are respectively fastened to said two action members of said action mechanism by a retaining piece.

5. The body shaping machine as defined in claim 4, wherein each of the two ends of said massaging belt is detachably fastened with to one of said two action members of said action mechanism by said retaining piece.

* * * * *